US008176986B2

(12) United States Patent
Warren et al.

(10) Patent No.: US 8,176,986 B2
(45) **Date of Patent: *May 15, 2012**

(54) METHOD OF CIRCULATING WHILE RETRIEVING BOTTOM HOLE ASSEMBLY IN CASING

(75) Inventors: Tommy M. Warren, Coweta, OK (US); Preston T. Honeycutt, Magnolia, TX (US); Michael Brouse, Houston, TX (US)

(73) Assignee: Tesco Corporation, Houston, TX (US)

( * ) Notice: Subject to any disclaimer, the term of this patent is extended or adjusted under 35 U.S.C. 154(b) by 337 days.

This patent is subject to a terminal disclaimer.

(21) Appl. No.: 12/491,966

(22) Filed: Jun. 25, 2009

(65) Prior Publication Data

US 2010/0200236 A1 Aug. 12, 2010

Related U.S. Application Data

(63) Continuation-in-part of application No. 12/184,851, filed on Aug. 1, 2008, now Pat. No. 7,845,417.

(51) Int. Cl.
*E21B 23/00* (2006.01)

(52) U.S. Cl. ..... 166/377; 166/90.1

(58) Field of Classification Search ..... 166/377, 166/90.1, 81.1

See application file for complete search history.

(56) References Cited

U.S. PATENT DOCUMENTS

| | | | | |
|---|---|---|---|---|
| 1,418,612 | A * | 6/1922 | Beard | 166/81.1 |
| 2,096,882 | A * | 10/1937 | Chernosky | 166/81.1 |
| 4,651,837 | A | 3/1987 | Mayfield | |
| 5,121,796 | A * | 6/1992 | Wigington, Sr. | 166/379 |
| 5,472,057 | A | 12/1995 | Winfree | |
| 7,044,241 | B2 | 5/2006 | Angman | |
| 7,140,443 | B2 | 11/2006 | Beierbach et al. | |
| 7,140,455 | B2 | 11/2006 | Walter et al. | |
| 7,845,417 | B2 * | 12/2010 | Warren et al. | 166/377 |
| 2006/0124306 | A1 | 6/2006 | Vail, III | |
| 2007/0074908 | A1 | 4/2007 | Utter | |

* cited by examiner

*Primary Examiner* — Hoang Dang
(74) *Attorney, Agent, or Firm* — Bracewell & Giuliani LLP

(57) ABSTRACT

Retrieving a down hole tool at a lower end of a string of casing can be performed with drill pipe during a casing-while-drilling operation. The operator suspends the casing on a landing sub landed in a drilling rig floor opening. A string of drill pipe is lowered into the casing while the casing is suspended for engaging and retrieving the down hole tool. A spillage preventer in the landing sub prevents spillage of drilling fluid as the drill pipe is being retrieved. When circulation is desired, the operator secures a circulation tool to an upper end of the drill pipe, then lowers the drill pipe and the circulation tool to close off an upper end of an inner annulus between the drill pipe and the casing. A connection between the circulation tool and the landing sub allows the operator to reciprocate the casing.

14 Claims, 5 Drawing Sheets

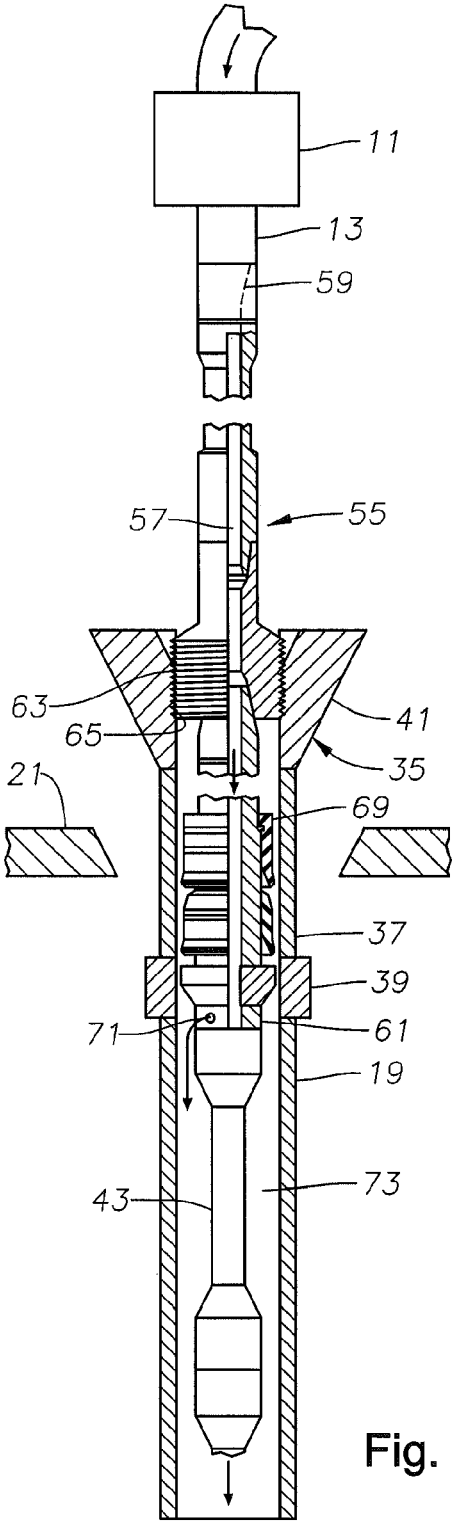
Fig. 5
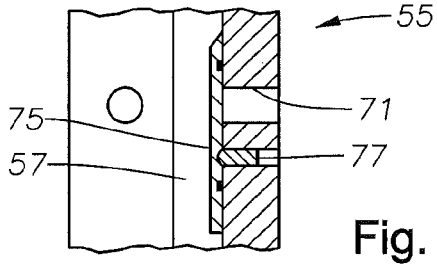
Fig. 6
Fig. 7
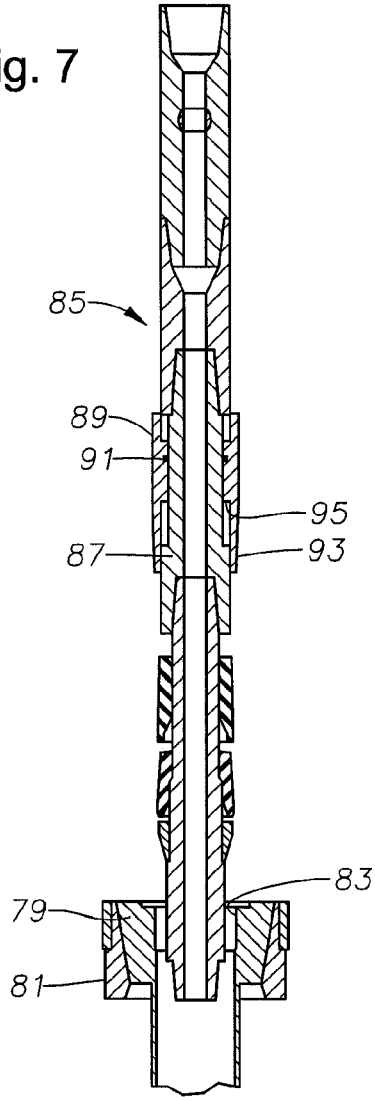

METHOD OF CIRCULATING WHILE RETRIEVING BOTTOM HOLE ASSEMBLY IN CASING

CROSS-REFERENCE TO RELATED APPLICATION

This application is a continuation-in-part of Ser. No. 12/184,851, filed Aug. 1, 2008, U.S. Pat. No. 7,845,417.

FIELD OF THE INVENTION

This invention relates in general to casing wells while drilling and in particular to circulating and reciprocating the casing while retrieving the bottom hole assembly with drill pipe.

BACKGROUND OF THE INVENTION

Most oil and gas wells are drilled using drill pipe. After a certain depth is reached, the operator runs a string of casing into the open borehole and cements the casing in place. The operator may then run drill pipe into the casing to drill below the casing to a greater depth. In a casing-while-drilling technique, all or a portion of the well is drilled using the casing as the drill string. The operator mounts a bottom hole assembly to the lower end of the casing. The bottom hole assembly includes a drill bit and a reamer. The operator may rotate the casing, which in turn rotates the drill bit to drill the well. The operator may also employ a mud motor that rotates the drill bit relative to the casing in response to drilling mud pumped down the casing.

Prior to reaching the total desired casing setting depth, the operator may wish to retrieve the bottom hole assembly, such as to replace a worn drill bit. Also, when reaching the casing setting depth or total depth, the operator may wish to retrieve the bottom hole assembly rather than cement it in place. One technique for retrieving the bottom hole assembly is to lower a wireline through the casing, latch it to the bottom hole assembly, then retrieve the wireline along with the bottom hole assembly. While successful, this technique requires special equipment not always found on a drilling rig, such as a wireline winch and sheaves to guide and lower the wireline into the casing. Another technique involves pumping the bottom hole assembly up the casing by reverse circulating. However, some operators fear that reverse circulation will damage the open hole formation. Another technique involves running drill pipe through the casing, latching the drill pipe to the bottom hole assembly, then retrieving the drill pipe along with the bottom hole assembly. Most drilling rigs will have equipment of this nature available.

Running the drill pipe and tripping it out to retrieve a bottom hole assembly takes a number of hours, depending on the depth of the well. A possibility exists that the casing may become stuck in the well while the drill pipe is tripped in and out. This can particularly be a problem if the operator plans to drill deeper with the string of casing. To avoid the casing sticking, it would be desirable to circulate up the outer annulus between the casing and the bore hole from time to time. Also, reciprocating the casing up and down reduces the chances of it becoming stuck.

Another issue while retrieving and re-running a bottom hole assembly is to provide a safety barrier in the event that a formation begins to flow liquid or gas, referred to as a "kick" while the drill pipe is located inside the casing. It is known that if such a kick occurs while running casing, the kick can normally be controlled by circulating fluid through the casing. However, no arrangement presently exists that allows circulation through the casing while a string of drill pipe is being run in or retrieved inside casing.

SUMMARY OF INVENTION

When the operator wishes to retrieve a bottom hole assembly or down hole tool from the casing during a casing-while-drilling operation, he will first suspend the casing in the well from a drilling rig floor opening, such as the rotary table. The operator runs a string of conduit, normally drill pipe, into the casing while the casing is suspended by a landing sub in order to engage and retrieve the down hole tool. The landing sub has a spillage preventer to prevent spillage of drilling fluid from the casing that may be induced to flow upward during retrieval.

In one embodiment, the spillage preventer comprises an elastomeric stripper mounted in the bore of the landing sub. In another embodiment, the spillage preventer comprises a port extending from the bore of the landing sub to the exterior. A deflecting skirt may be mounted to the landing sub exterior of the port for deflecting fluid flowing out the port.

When circulation is desired, either while running the drill pipe in or tripping it out, the operator secures a circulation tool to the upper end of the drill pipe. If the spillage preventer is a stripper, the operator may remove the stripper before lowering the circulation tool into the upper end of the drill pipe. He then lowers the drill pipe and the circulation tool so that the circulation tool closes off an upper end of the inner annulus between the drill pipe and the casing. If the spillage preventer comprises the port, the annulus is closed off below the port. The operator then circulates fluid down through the circulation tool and drill pipe and back up an outer annulus surrounding the casing.

In addition to circulating, the circulation tool also allows the operator to reciprocate the casing up and down while the drill pipe is located inside. The circulation tool and the landing sub have a cooperative fastener to connect the circulation tool to the landing sub. The cooperative fastener may be threads, snap ring and grooves, collets and locking dogs, or other tubular connectors. Preferably, the cooperative fastener in the landing sub is located above where the stripper attaches in that embodiment. In the embodiment wherein the landing sub has a port, the cooperative fastener is preferably below the port. Lifting the circulation tool with the top drive causes the landing sub, the casing, and the drill pipe to move upward in unison. The reciprocation can occur simultaneously while pumping fluid down the drill pipe.

BRIEF DESCRIPTION OF THE DRAWINGS

FIG. 5 is a schematic, partially sectional view of the circulation tool of FIG. 4, but showing the casing and the drill pipe being lifted by the top drive.

FIG. 6 is an enlarged sectional view illustrating a sliding sleeve in the circulation sub of FIG. 5.

FIG. 7 is a more detailed sectional view of the circulation sub of FIG. 4.

DETAILED DESCRIPTION OF INVENTION

Figure 1:
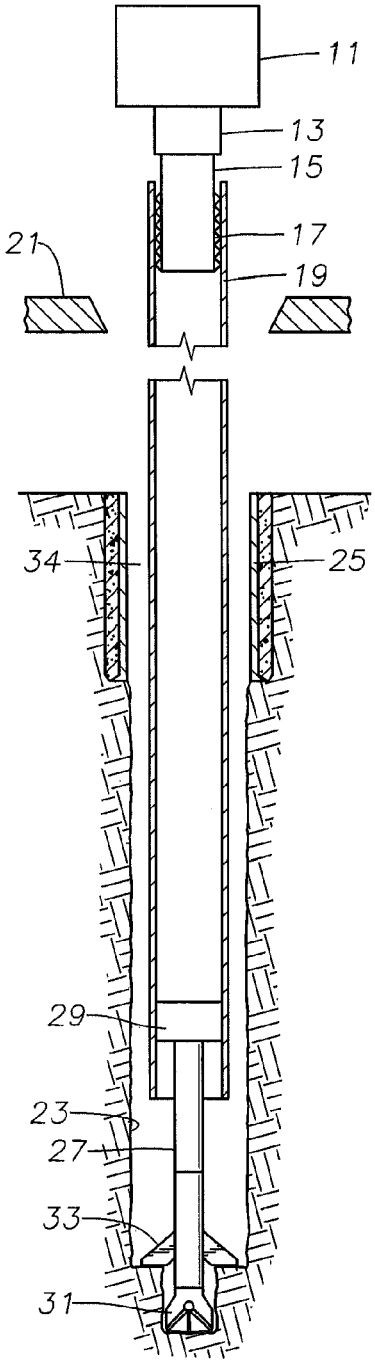
FIG. 1 is a schematic sectional view of a top drive, casing gripper and casing string assembly employed in this invention and performing casing drilling.

Referring to FIG. 1, top drive 11 is a conventional top drive of a drilling rig that moves up and down a derrick (not shown). Top drive 11 has a drive quill 13 that it rotates. A casing gripper 15 is mounted to drive quill 13 during a casing-while-drilling operation. Casing gripper 15 has slips 17 on a lower portion that are moved radially by an actuator to grip casing 19. In this embodiment, slips 17 are moved outward to grip the inner diameter of casing 19. Alternatively, the slips of casing gripper 15 could be arranged to fit around the casing and move inward to grip the exterior of casing 19.

Casing 19 is a string of conduit made up of sections of pipe secured together by couplings or casing collars. Casing 19 is eventually cemented in a wellbore to line the wellbore. Normally casing 19 extends from the bottom to the top of the wellbore where it is secured to a wellhead assembly (not shown). The term "casing" is also meant to include other tubular strings cemented in a well, such as liners, which are also threaded pipes that are cemented in a well; unlike casing strings, liners do not extend all the way back to the surface.

Casing 19 extends through an opening in the rig floor structure, such as rotary table 21. Rotary table 21 normally has the ability to rotate pipe suspended by it. Casing 19 extends into an open hole portion of well 23. In this embodiment, an upper string of casing 25 is illustrated as being previously cemented in place.

A down hole tool or bottom hole assembly 27 is carried at or near the lower end of casing 19. Bottom hole assembly 27 extends out the lower end of casing 19 and has an upper portion 29 that may comprise a latch that latches to a profile within casing 19. A pilot bit 31 is attached to the lower end of bottom hole assembly 27. A reamer 33 is located either at the lower end of casing 19 or some distance below for reaming out an outer portion of well 23 being drilled by pilot bit 31. Reamer 33 is typically collapsible to allow bottom hole assembly 27 to be retrieved upwards inside casing 19. During the drilling operation, drilling fluid or mud is circulated through top drive 11, casing gripper 15, casing 19 and out nozzles at the lower end of drill bit 31. The drilling fluid circulates back up an outer annulus 34 between casing 19 and well 23.

Figure 2:
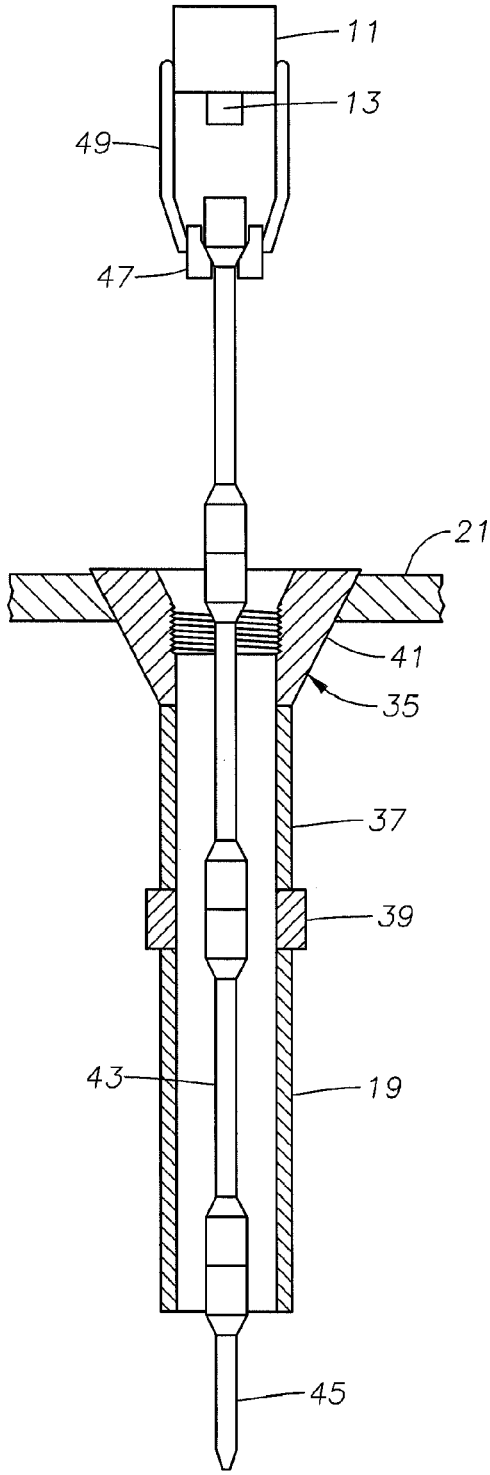
FIG. 2 is a schematic sectional view of part of the assembly of FIG. 1, showing a landing sub in accordance with this invention while retrieving the drill bit with a string of drill pipe.

The operator will need to retrieve bottom hole assembly 27 when reaching total depth unless the bottom hole assembly 27 is of a type to be cemented in place. Also, the operator may need to retrieve bottom hole assembly 27 before reaching total depth, such as to change out drill bit 31. To retrieve bottom hole assembly 27, the operator will first suspend casing 19 independently of top drive 11, as illustrated in FIG. 2. In this embodiment, preferably casing 19 is suspended by first attaching a landing sub 35 to the casing collar 39 at the upper end of the string of casing 19. Landing sub 35 has a tubular lower portion or adapter 37 with an externally threaded end for engaging casing collar 39. Alternatively, the landing sub may employ a non-threaded fastener for engaging casing collar 39. Landing sub 35 has an upper end 41 that is enlarged and has a tapered surface on its exterior. Preferably, lower portion 37 is releasably secured to upper end 41 so that it can be readily changed out for different sizes of casing 19. Lower portion 37 may be releasably secured to upper end 41 using threads, snap ring and grooves, collets and locking dogs, or other tubular connectors. The exterior tapered surface of upper end 41 increases in diameter in an upward direction for mating within the bowl in rotary table 21. When seated within rotary table 21 as shown in FIG. 2, the upper end of landing sub 35 is substantially flush with rotary table 21.

Once casing 19 is suspended as shown in FIG. 2, the operator will use top drive 11 to make up and lower a string of conduit, normally drill pipe 43. Drill pipe 43 is made up of sections of pipe with integral upset ends that are secured together. A retrieving tool 45 is mounted on the lower end of the string of drill pipe 43 for engaging latch assembly 29 (FIG. 1) of bottom hole assembly 27. Retrieving tool 45 unlatches bottom hole assembly 27 from casing 19 and latches to bottom hole assembly 27 for retrieval. When running drill pipe 43, the operator would normally use elevators 47 for lowering the string of drill pipe 43 into casing 19. Elevators 47 are mounted on bails 49 that are pivotally secured to top drive 11.

Figure 3:
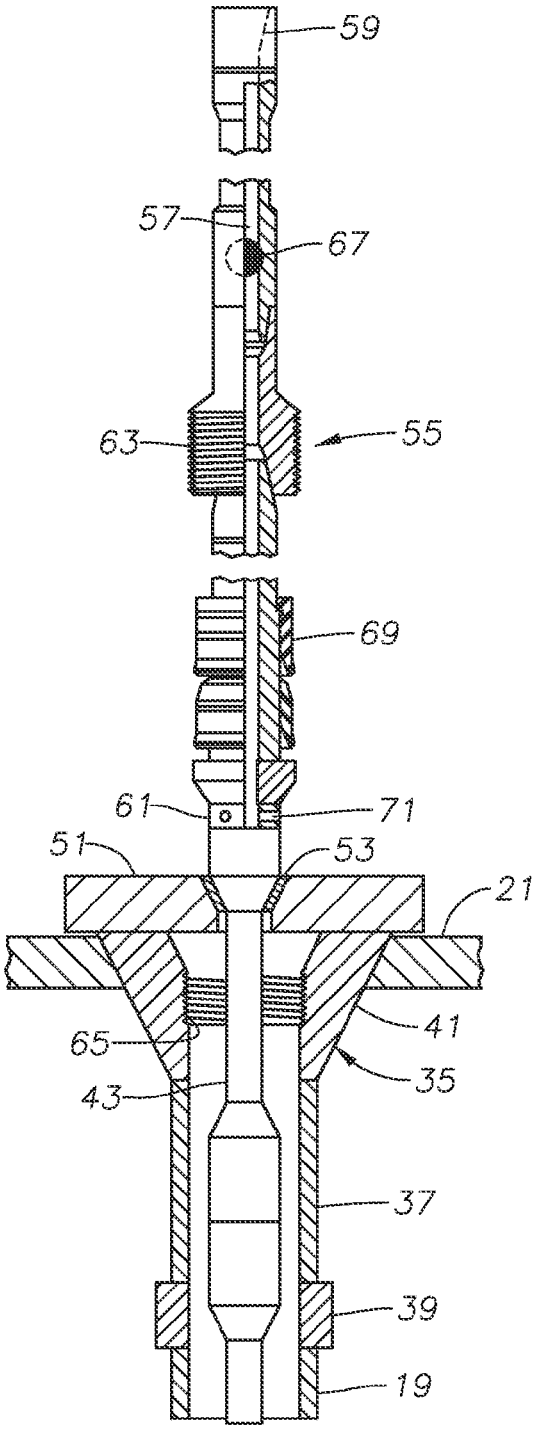
FIG. 3 is a schematic, partially sectional view of a circulation tool in accordance with an embodiment of this invention, above a suspended drill pipe.

At one or more occasions while tripping drill pipe 43 in and out, the operator will likely wish to circulate down casing 19 and up outer annulus 34 (FIG. 1) as well as reciprocate casing 19 to avoid casing 19 becoming stuck. Circulation also reduces the chance of a kick occurring due to inflow of gas or other fluid from one of the formations in the open hole portion of well 23 (FIG. 1). Furthermore, if a heavier fluid is circulated down casing 19, the heavier fluid may be sufficient to overcome the kick. The operator may wish to circulate and reciprocate casing 19 more than once while tripping drill pipe 43 in and more than once while tripping drill pipe 43 out. Each time the operator wishes to circulate and reciprocate, he will first suspend drill pipe 43 independently of top drive 11 (FIG. 2), as shown in FIG. 3. In FIG. 3, the operator places a spider 51 over the upper end of landing sub 35. Spider 51 has slips 53 that will support the string of drill pipe 43.

Figure 4:
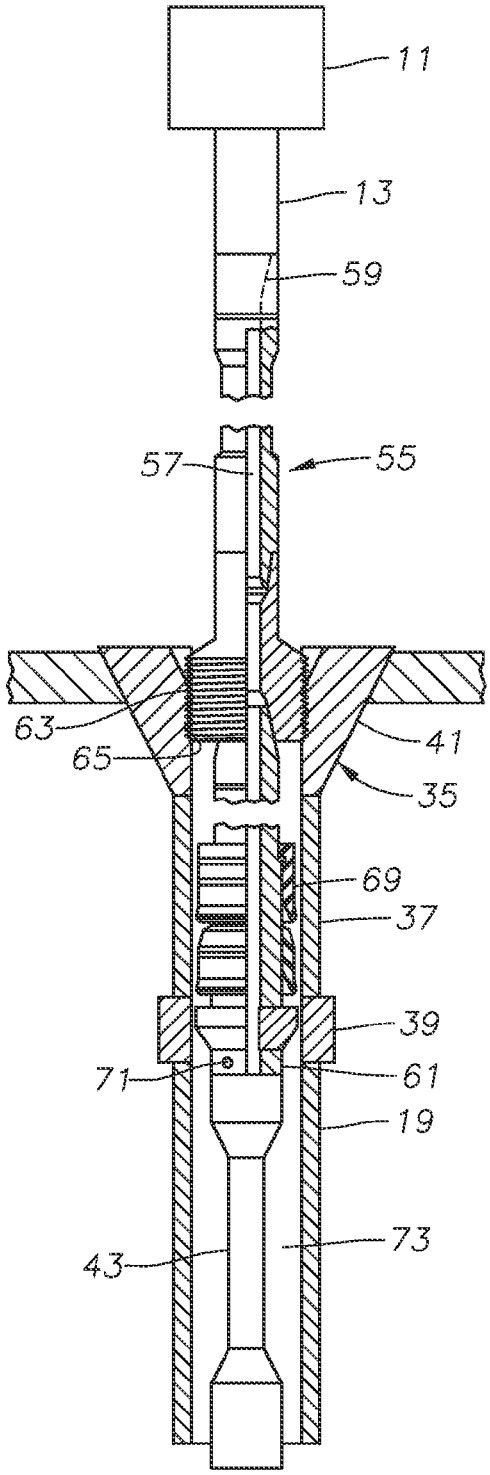
FIG. 4 is a schematic, partially sectional view of a circulation tool in accordance with this invention, installed within a landing sub, connected to drill pipe, and shown supported on a spider resting on the rotary table.

Then, using top drive 11 (FIG. 2) or another means, the operator will lift a circulation tool 55 above the suspended drill pipe 43 as illustrated in FIG. 3. Circulation tool 55 has an axial passage 57 extending through it. Circulation tool 55 has a threaded upper end 59 that is secured to drive quill 13 of top drive 11 (FIG. 2). Circulation tool 55 has a threaded lower end 61 that connects to the upper end of the string of drill pipe 43, either directly or via an adapter (not shown). Alternatively, the connection between the circulation tool 55 and the lower end 61 may use snap ring and grooves, collets and locking dogs, or other tubular connectors. A mid section of circulation tool 55 has an engagement member for securing circulation tool 55 to landing sub 35. In this embodiment, the engagement member comprises external threads 63 on the mid section of circulation tool 55 that engage internal threads 65 in landing sub 35. Threads 63 are preferably rotatable relative to circulation tool 55. Other arrangements are possible, such as a J-pin and slot, a breach lock, or a floating threaded drive nut. FIG. 4 shows top drive 11 lowering circulation tool 55 and drill pipe 43 into a position wherein external threads 63 are engaging internal thread 65. The drilling rig tongs (not shown) can be used to make up circulation tool 55 with landing sub 35.

Circulation tool 55 may also optionally have a ball valve 67 in axial passage 57 to block upward flow of fluid if desired. In addition, in this embodiment, circulation tool 55 has a cup seal 69 (two shown) that will seal and engage the inner diameter of casing 19 or landing sub 35. Other casing seals (o-rings, d-rings, FS seals, etc.) may also be used on the circulation tool 55 to effect a seal with the casing. Preferably the inner diameter of the lower portion 37 of landing sub 35 is the same as the inner diameter of casing 19, thus cup seal 69 can seal to the inner diameter of casing 19 or to the inner diameter of landing sub lower portion 37.

Also, circulation tool 55 optionally may have one or more circulation ports 71 (FIG. 5). Each port 71 extends from axial passage 57 to the exterior of circulation tool 55 below cup seal 69. Ports 71 thus communicate axial passage 57 with an inner annulus 73 located between drill pipe 43 and casing 19. In the embodiment of FIGS. 3-5, inner annulus circulation ports 71 are always open. Alternately, the operator may wish to selectively close inner annulus ports 71. FIG. 6 illustrates one arrangement showing a selectively closed arrangement. A sliding sleeve 75 is mounted in axial passage 57 in an initial position blocking inner annulus ports 71. Sleeve 75 can be moved from an upper to a lower position to open ports 71 to axial passage 57. In this example, sleeve 75 has a shear pin 77 mounted to it. The operator opens sleeve 75 by dropping a ball or dart into axial passage 57. Fluid pressure from a pump at the surface is applied to the ball or dart, causing shear pin 77 to shear, and moving sleeve 75 downward. Also, threaded screw-in plugs could be employed to close ports 71, if desired. Other known plugging or valving arrangements may also be used to close the port 71 if desired.

In the operation of the embodiment of FIGS. 1-5, to retrieve bottom hole assembly 27, the operator will temporarily support casing 19 in slips of rotary table 21. The operator then attaches landing sub 35 to casing 19 and lowers the assembly until landing sub 35 seats within rotary table 21. The operator then runs a string of drill pipe 43 into casing 19 with top drive 11, as shown in FIG. 2. Periodically, the operator attaches circulation tool 55 between top drive 11 (FIG. 4) and drill pipe 43 as shown in FIG. 3. The operator lowers circulation tool 55 with top drive 11 and rotates threads 63 into engagement with landing sub threads 65. The operator then reciprocally lifts and lowers circulation tool 55 with top drive 11, as shown in FIG. 5. This causes landing sub 35, casing 19 and drill pipe 43 to move upward in unison. At the same time, the operator pumps drilling fluid down top drive 11, which flows through circulation tool axial passage 57, and downward through drill pipe 43. Some of the fluid is diverted through ports 71 to flow down inner annulus 73 between drill pipe 43 and casing 19. The fluid flowing down inner annulus 73 circulates the drilling mud contained within casing 19.

When the upward and downward reciprocation and circulation has gone on for a desired interval, the operator lowers landing sub 35 back to its seated position in FIG. 3. The operator removes circulation tool 55 and continues to either trip drill pipe 45 in or out. The operator will eventually engage retrieval tool 45 with the bottom hole assembly upper portion 29. This engagement is performed conventionally. The operator releases any latches that upper portion 29 may have with casing 19 and retrieves the entire bottom hole assembly 27. The operator may wish to circulate and reciprocate periodically while tripping out of the well with bottom hole assembly 27. If so, the operator repeats the procedure described above.

FIG. 7 illustrates an alternate embodiment, which is a more detailed version of the schematic drawing of circulation tool 55. Circulation tool 85 has a tubular multi-piece body 87. A floating nut 89 is mounted to a central portion of body 87 for movement between upper and lower positions. Nut 89 has an inner seal 91 that seals on an outer diameter portion of body 87. Nut 89 has external threads 93 that will engage landing sub threads 65 (FIG. 4). Nut 89 can be rotated relative to body 87 and may have lugs or a hexagonal exterior to facilitate that rotation. Upper and lower shoulders 95 limit the axial travel of nut 89 relative to body 87. The lower shoulders 95 will transmit the upward force when circulation tool 85 is lifted by top drive 11 (FIG. 5). Floating nut 89 allows circulation tool 85 to be connected to the landing sub without having to rotate circulation tool 85 and drill pipe 43 (FIG. 5). Floating nut 89 also can limit the axial loading on the threads 93 and 65 (FIG. 4) during the thread engagement period, and thus can prevent damage to the threads.

In the embodiment of FIG. 7, landing sub upper end 79 lands within a casing bushing 81, which in turn fits within rotary table 21 (FIG. 5). Casing bushing 81 has a tapered bowl and is considered to be a component of rotary table 21. Threads 83 of landing sub 79 are recessed so as to allow a thread protector (not shown) to be placed over them while drill pipe 43 is being run into and out of the well. The thread protector could comprise two semi-circular pieces that are simply placed over threads 83, each semi-circular half having an upper flange to support it on landing sub upper end 79.

Figure 8:
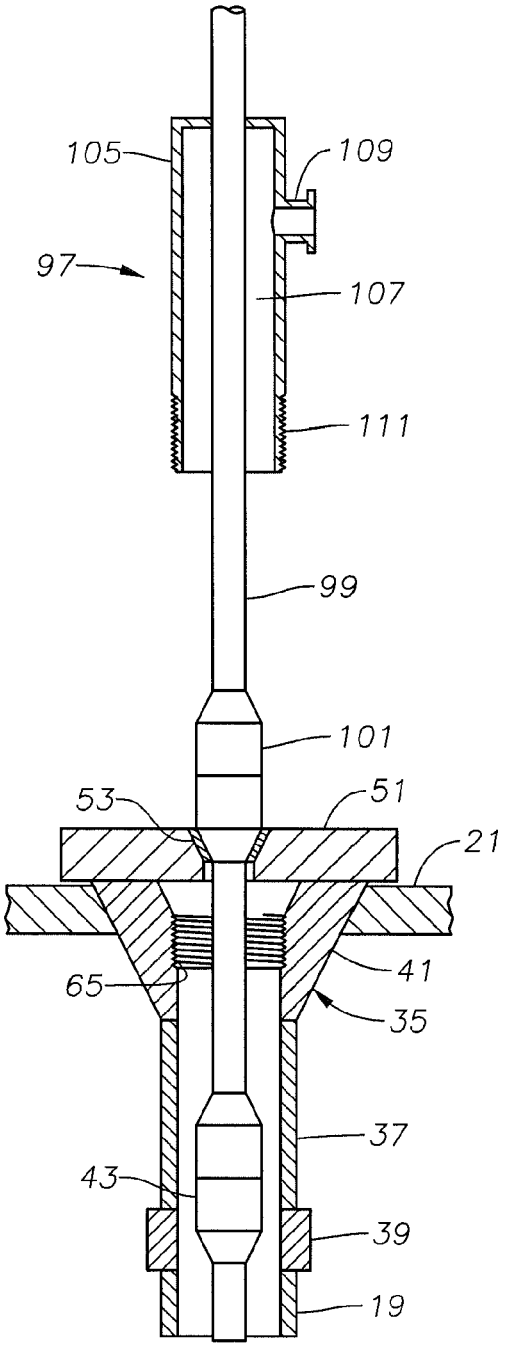
FIG. 8 is a schematic sectional view of an alternate embodiment of a circulation tool shown connected to a landing sub and to drill pipe and supported on a spider resting on the rotary table.
Figure 9:
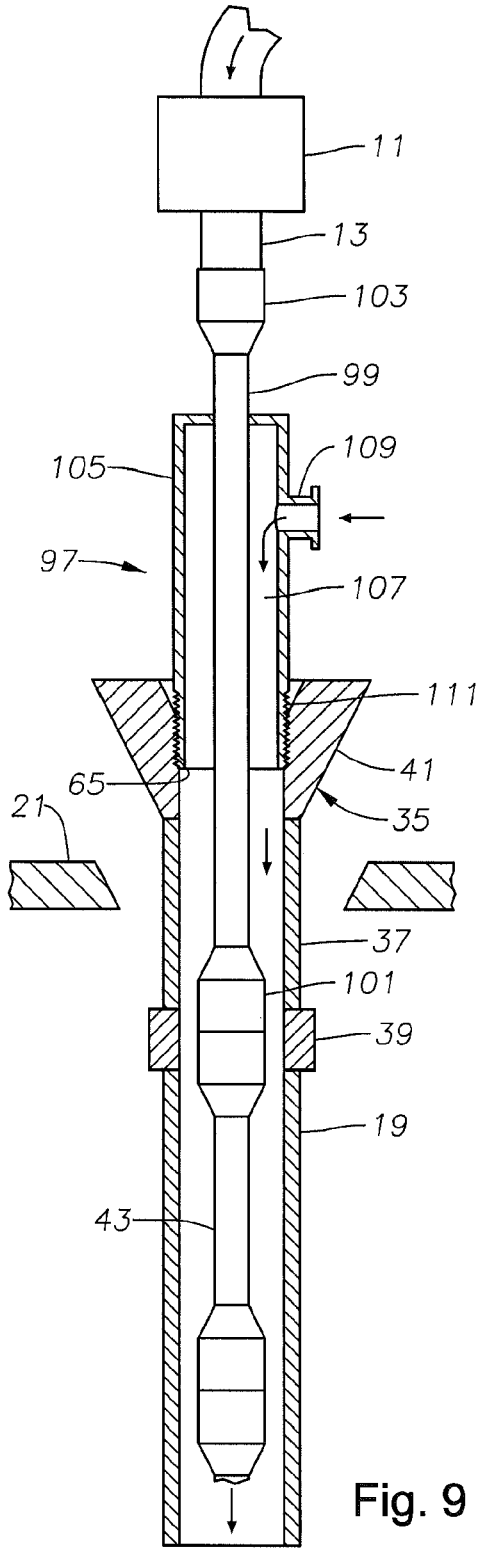
FIG. 9 is view of the circulation tool of FIG. 8, showing the top drive lifting the casing and the drill pipe.

FIGS. 8 and 9 illustrate another embodiment of a circulation tool. Circulation tool 97 has an inner pipe 99 that has a lower threaded end 101 that secures to drill pipe 43. Inner pipe 99 has an upper end 103 (FIG. 9) that connects to top drive quill 13. A housing 105 is secured to inner pipe 99. The upper end of inner pipe 99 is connected to inner pipe 99, as by welding, creating a closed upper end for housing 105. Housing 105 is larger in diameter than inner pipe 99, defining an annular chamber 107 between them. A side inlet 109 connects annular chamber 107 to an external source of fluid, such as drilling fluid. Housing 105 has external threads 111 on its lower end that engage landing sub threads 65, as shown in FIG. 9.

Circulation tool 97 is connected to drill pipe 43, as shown in FIG. 8, when it is desired to circulate and reciprocate. After connecting to drill pipe 43, the operator removes spider 51 and connects housing threads 111 to landing sub threads 65, as shown in FIG. 9. This allows top drive 11 to pick up the entire assembly of circulation tool 97, landing sub 35, drill pipe 43 and casing 19. The operator connects a source of fluid to side inlet 109 and pumps into annular chamber 107. Annular chamber 107 is open at its lower end, causing the fluid to flow down inner annulus 73 and return back outer annulus 34 (FIG. 1). If desired, the operator at the same time can pump down through top drive 11, inner pipe 99 and drill pipe 43.

The circulating systems of both embodiments allow an operator to readily circulate and reciprocate the casing while using drill pipe as a retrieving string to retrieve a bottom hole assembly from casing. The circulating systems also handle well pressure. The second embodiment allows an independent measurement of the shut-in pressure of the drill pipe and of the pressure within the annulus surrounding the drill pipe to be made.

Figure 10:
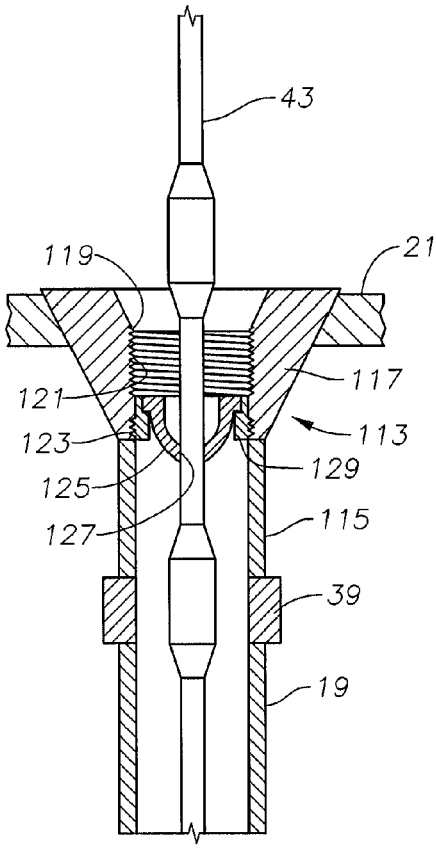
FIG. 10 is a schematic sectional view of an alternate embodiment of the landing sub of FIG. 2.
Figure 11:
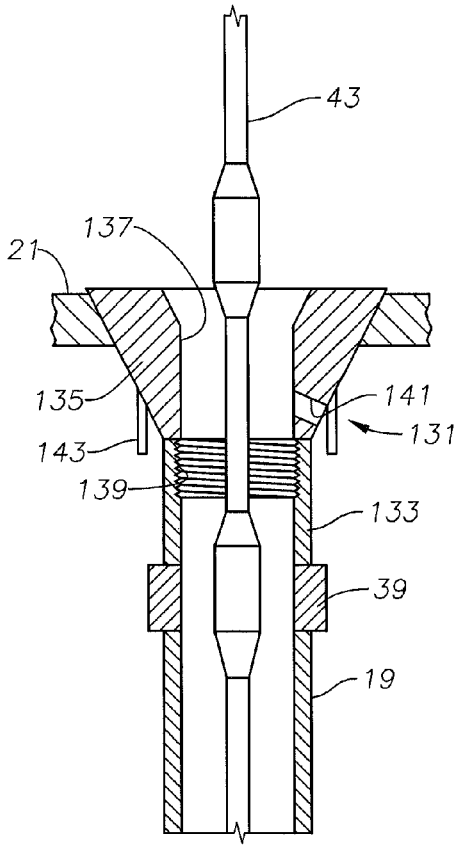
FIG. 11 is a schematic sectional view of another alternate embodiment of the landing sub of FIG. 2.

FIGS. 10 and 11 illustrate alternate embodiments of features for reducing drilling fluid spillage onto the rig floor. When drill pipe 43 is run into casing string 19 to retrieve bottom hole assembly 27 (FIG. 1), typically there is no displacement of drilling fluid onto the rig floor. The downward movement of drill pipe 43 tends to push drilling fluid out the bottom of casing string 19. However, when retrieving bottom hole assembly 27, the tendency is to displace drilling fluid upwards so that it may spill over the top of casing string 19. With casing string 19 supported by rotary table 21, the fluid spills onto the rig floor. Reducing the speed of the upward movement of drill pipe 43 reduces spillage, but also slows down the time to trip out bottom hole assembly 27.

Referring to FIG. 10, landing sub 113 is similar to landing sub 35 in the other embodiments. It has a tubular adapter 115 that secures to the threads in casing collar 39. Landing sub 113 has an upper end 117 with an enlarged outer diameter for landing within rotary table 21. A central bore 119 extends through landing sub 113. An upper profile, preferably a set of threads 121, is located in bore 119 within upper end 117. Threads 121 are similar to threads 65 (FIG. 4) and are engaged by threads 63 (FIG. 4) of circulation tool 55. A lower profile, preferably a set of lower threads 123, is formed in bore 119 below upper threads 121.

A stripper 125 is mounted to lower threads 123 before beginning to pull drill pipe 43 upward. Stripper 125 is a flexible elastomeric member with a hole 127 through it for closely receiving drill pipe 43. Stripper 125 is attached to lower threads 123 in this embodiment by a stripper mount 129. Stripper mount 129 could be formed in two halves to facilitate installation around drill pipe 43. Also, mounting profiles rather than threads 123 could be used. In addition, a single set of threads 121 could be employed both for stripper 125 and one of the circulation tools 55, 85 or 87 described above.

In the operation of the embodiment of FIG. 10, it is normally not installed during the run-in of drill pipe 43. Rather it is preferably installed only when beginning to pull drill pipe 43 upward. Once installed, stripper 125 blocks upward flowing drilling fluid from casing string 19. Although it does not form a tight seal at the upper end of the annulus between drill pipe 43 and casing string 19, it does serve to block flow induced by the upward movement of drill pipe 43 because it extends completely across the annulus. When the enlarged tool joint or connections of drill pipe 43 pass through stripper 125, hole 127 expands to accommodate the larger diameter.

If the operator wishes to circulate and/or reciprocate casing string 19, this would be performed as in the other embodiments. In the embodiment of FIGS. 8 and 9, circulation tool 97 would not extend lower than threads 123, thus stripper 125 could remain in place while circulation tool 97 is attached to threads 121 of landing sub 113. In the embodiment of FIGS. 3-7, circulating tools 55 and 85 would extend downward past threads 123, thus stripper 125 would be removed before either of those tools is attached to threads 121 of landing sub 113.

In the embodiment of FIG. 11, landing sub 131 has a tubular adapter 133 and an upper end 135 that has an enlarged exterior as in the other embodiments. A bore 137 extends through upper end 135 and adapter 133. A single set of threads 139 is located within adapter 133 below upper end 135. One or more ports 141 extend from bore 137 to the exterior of upper end 135. Port 141 is located above threads 139. A skirt 143 may be mounted to landing sub 131 radially outward from port 141. Skirt 143 may be a cylindrical member extends completely around upper end 135.

In the operation of the embodiment of FIG. 11, during retrieval of drill pipe 43, drilling fluid that flows upward as a result of the upward movement of drill pipe 43 flows out port 141, and is deflected downward by skirt 143. A stripper element between drill pipe 43 and landing sub 131 may not be required.

When one of the circulation tools 55, 85 or 97 is attached, it will attach to threads 139 below port 141. Circulation and reciprocation may take place as described above.

While the invention has been shown in only a few of its forms, it should be apparent to those skilled in the art that it is not so limited but susceptible to various changes without departing from the scope of the invention.

The invention claimed is:

1. A method of retrieving a bottom hole assembly releasably connected to a lower end of a casing string during a casing-while-drilling operation, comprising:

(a) securing a landing sub to an upper end of the casing string and seating the landing sub within a rotary table of the drilling rig, thereby suspending the casing string;

(b) providing the landing sub with a drilling fluid spillage preventer;

(c) running a conduit string into the casing string while it is suspended and engaging and retrieving the bottom hole assembly with the conduit string;

(d) while retrieving the bottom hole assembly, with the spillage preventer, preventing drilling fluid within the casing string from spilling out an upper end of the landing sub.

2. The method according to claim 1, wherein:

step (b) comprises attaching an elastomeric stripper within a main bore of the landing sub; and step (d) comprises pulling the conduit string through a hole provided in the stripper.

3. The method according to claim 1, wherein:

step (b) comprises providing a port through a sidewall of the landing sub; and step (d) comprises discharging out the port drilling fluid drawn upwardly into the landing sub while retrieving the bottom hole assembly.

4. The method according to claim 3, further comprising:

mounting a deflector to the landing sub adjacent and outward from the port, and with the deflector, deflecting downward drilling fluid flowing out the port.

5. The method according to claim 1, further comprising:

when circulation is desired while the conduit string is located within the casing string, securing a circulation tool to an upper end of the conduit string, lowering the conduit string and the circulation tool and closing off an upper end of an inner annulus between the conduit string and the casing string; and circulating fluid down through the circulation tool and the conduit string and back up an outer annulus surrounding the casing string.

6. The method according to claim 2, further comprising:

when circulation is desired while the conduit string is located within the casing string, removing the stripper, securing a circulation tool to an upper end of the conduit string, lowering the conduit string and the circulation tool, and with the circulation tool, closing off an upper end of an inner annulus between the conduit string and the casing string; and circulating fluid down through the circulation tool and the conduit string and back up an outer annulus surrounding the casing string.

7. The method according to claim 3, further comprising:

when circulation is desired while the conduit string is located within the casing string, securing a circulation tool to an upper end of the conduit string, lowering the conduit string and the circulation tool, and with the circulation tool, closing off below the port an upper end of an inner annulus between the conduit string and the casing string; and circulating fluid down through the circulation tool and the conduit string and back up an outer annulus surrounding the casing string.

8. The method according to claim 3, further comprising:

when circulation is desired while the conduit string is located within the casing, securing a circulation tool to an upper end of the conduit string, lowering the conduit string and the circulation tool and securing the circulation tool to the landing sub at a point below the port, and with the circulation tool, closing off below the port an upper end of an inner annulus between the conduit string and the casing string;

circulating fluid down through the circulation tool and the conduit string and back up an outer annulus surrounding the casing; and repeatedly raising and lowering the casing string a short distance by raising and lowering the conduit string.

9. A method of retrieving a bottom hole assembly releasably connected to a lower end of a string of casing during a casing-while-drilling operation, comprising:

(a) providing a tubular landing sub having a bore, a threaded lower end, and an upper end that has an enlarged outer diameter, screwing the lower end of the landing sub to a threaded upper end of the casing, and seating the upper end of the landing sub within a drilling rig floor opening to suspend the casing in the well;

(b) running a string of drill pipe into the casing while the casing is suspended;

(c) attaching an elastomeric stripper to the landing sub within the bore of the landing sub;

(d) securing the drill pipe to the bottom hole assembly and retrieving the drill pipe along with the bottom hole assembly by pulling the drill pipe through a hole provided in the stripper;

(e) when circulation is desired, removing the stripper and securing a circulation tool to an upper end of the drill pipe, lowering the drill pipe until at least a portion of the circulation tool is inserted into the landing sub, and closing off an upper end of an inner annulus between the conduit and the casing; and (f) circulating fluid down through the circulation tool and the drill pipe and back up an outer annulus surrounding the casing.

10. The method according to claim 9, further comprising:

when reciprocation of the casing is desired, with the stripper removed, securing the circulation tool to the landing sub, and raising and lowering the circulation tool.

11. The method according to claim 10, wherein securing the circulation tool to the landing sub is performed at a point above where the stripper attaches to the landing sub.

12. A method of retrieving a bottom hole assembly releasably connected to a lower end of a string of casing during a casing-while-drilling operation, comprising:

(a) providing a tubular landing sub having a bore, a threaded lower end, and an upper end that has an enlarged outer diameter, a port near the upper end that leads from the bore to an exterior portion of the landing sub;

(b) screwing the lower end of the landing sub to a threaded upper end of the casing, and seating the upper end of the landing sub within a drilling rig floor opening to suspend the casing in the well;

(c) running a string of drill pipe into the casing while the casing is suspended;

(d) securing the drill pipe to the bottom hole assembly and retrieving the drill pipe along with the bottom hole assembly;

(e) while retrieving the drill pipe, diverting out the port drilling fluid that may be induced to flow upward as the drill pipe moves upward;

(f) when circulation is desired, securing a circulation tool to an upper end of the drill pipe, lowering the drill pipe until at least a portion of the circulation tool is inserted into the landing sub, and closing off below the port an upper end of an inner annulus between the conduit and the casing; and (g) circulating fluid down through the circulation tool and the drill pipe and back up an outer annulus surrounding the casing.

13. The method according to claim 12, further comprising:

when reciprocation of the casing is desired, securing the circulation tool to the landing sub at a point below the port, and raising and lowering the circulation tool.

14. The method according to claim 12, further comprising:

mounting a deflector to the landing sub adjacent and outward from the port, and with the deflector, deflecting downward drilling fluid flowing out the port.

* * * * *